US009269217B2

(12) United States Patent
Hamlin et al.

(10) Patent No.: US 9,269,217 B2
(45) Date of Patent: Feb. 23, 2016

(54) INFRARED DISPLAYS FOR HUMAN INTERFACES VIEWABLE BY CAMERA

(71) Applicant: WMS Gaming Inc., Waukegan, IL (US)

(72) Inventors: Vernon W. Hamlin, Lisle, IL (US); Andrew C. Guinn, Chicago, IL (US); Timothy C. Loose, Chicago, IL (US); Brian C. Marrant, Glendale Heights, IL (US); Jim Motyl, Chicago, IL (US)

(73) Assignee: Bally Gaming, Inc., Las Vegas, NV (US)

( * ) Notice: Subject to any disclaimer, the term of this patent is extended or adjusted under 35 U.S.C. 154(b) by 73 days.

(21) Appl. No.: 13/792,978

(22) Filed: Mar. 11, 2013

(65) Prior Publication Data

US 2013/0260882 A1 Oct. 3, 2013

Related U.S. Application Data

(60) Provisional application No. 61/610,697, filed on Mar. 14, 2012.

(51) Int. Cl.
*G07F 17/32* (2006.01)

(52) U.S. Cl.
CPC ..... *G07F 17/3211* (2013.01)

(58) Field of Classification Search
USPC ..... 463/28, 29, 30, 31
See application file for complete search history.

(56) References Cited

U.S. PATENT DOCUMENTS

| | | | | |
|---|---|---|---|---|
| 6,498,860 | B1 | 12/2002 | Sasaki et al. | |
| 6,522,312 | B2 | 2/2003 | Ohshima et al. | |
| 6,554,706 | B2 | 4/2003 | Kim et al. | |
| 6,663,391 | B1 | 12/2003 | Otowa | |
| 7,140,962 | B2 | 11/2006 | Okuda et al. | |
| 8,002,619 | B2 | 8/2011 | Gagner et al. | |
| 2006/0252530 | A1 * | 11/2006 | Oberberger et al. | 463/29 |
| 2007/0024527 | A1 | 2/2007 | Heikkinen et al. | |
| 2008/0207296 | A1 * | 8/2008 | Lutnick et al. | 463/16 |
| 2008/0268934 | A1 * | 10/2008 | Mattice et al. | 463/16 |
| 2009/0088243 | A1 * | 4/2009 | Gagner et al. | 463/25 |
| 2010/0029380 | A1 * | 2/2010 | Rhoads et al. | 463/29 |
| 2011/0065496 | A1 | 3/2011 | Gagner et al. | |
| 2012/0184352 | A1 | 7/2012 | Detlefsen et al. | |
| 2013/0083066 | A1 | 4/2013 | Aoki et al. | |
| 2013/0210523 | A1 | 8/2013 | Arumugam et al. | |

* cited by examiner

*Primary Examiner* — Paul A D'Agostino
*Assistant Examiner* — Brandon Gray
(74) *Attorney, Agent, or Firm* — Nixon Peabody LLP

(57) ABSTRACT

Gaming-related displays present text and graphics viewable with a special visual aid, e.g., a camera phone. The visual aid provides an interface allowing the player to interact with, and be engaged by, the gaming machine and the gaming environment. The text and graphics shown on the visual aid may provide information that adds to the player's experience. For example, a gaming system includes a gaming terminal for a wagering game. The gaming terminal includes a light-emitting area emitting a predetermined pattern of invisible light having wavelengths outside the visible electromagnetic spectrum. The gaming system also includes a visual aid including a sensor and a visual aid display. The visual aid detects, with the sensor, the pattern of invisible light, converts the pattern of invisible light into a pattern of visible light having wavelengths inside the visible electromagnetic spectrum, and displays the pattern of visible light on the visual aid display.

17 Claims, 14 Drawing Sheets

FIG. 4D
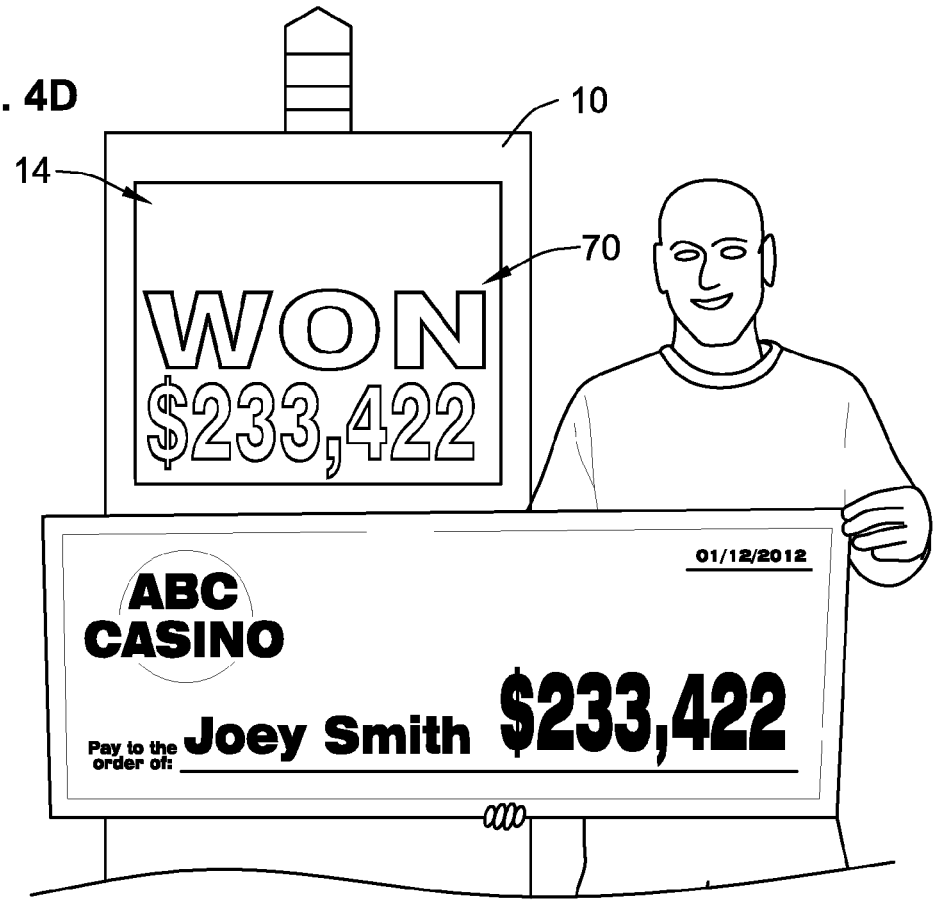
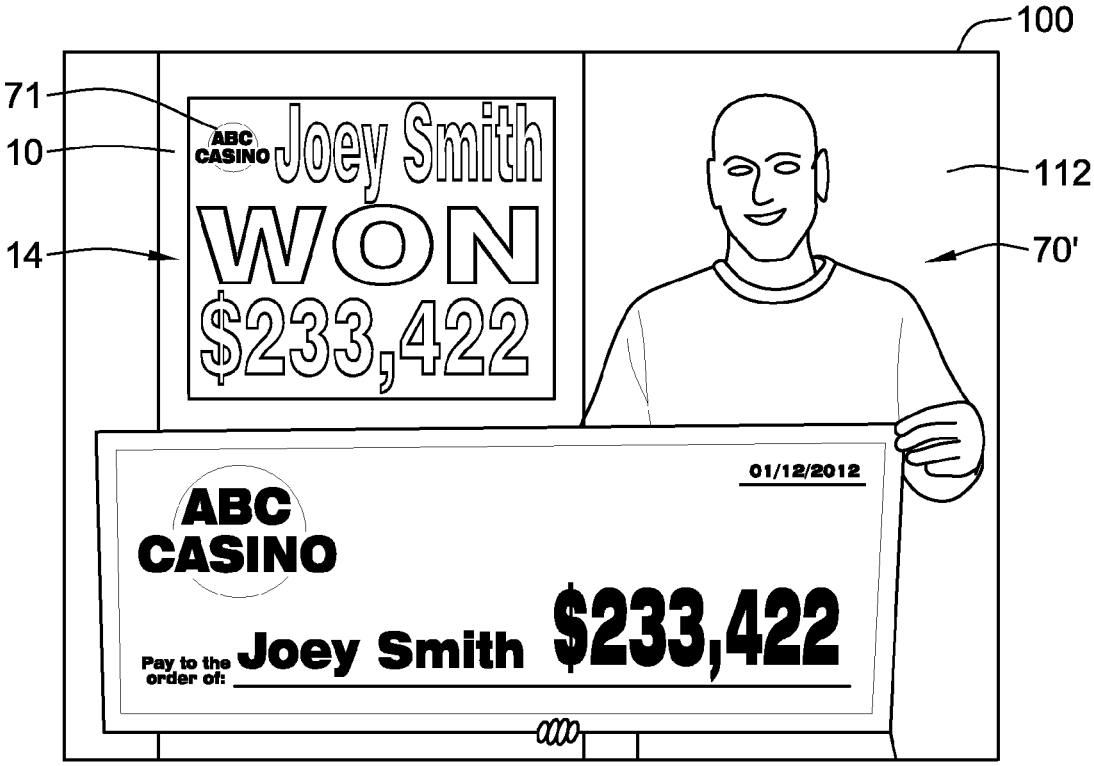
FIG. 4E

INFRARED DISPLAYS FOR HUMAN INTERFACES VIEWABLE BY CAMERA

CROSS-REFERENCE TO RELATED APPLICATION

This application claims the benefit of U.S. Provisional Application No. 61/610,697, filed Mar. 14, 2012, which is hereby incorporated by reference herein in its entirety.

COPYRIGHT

A portion of the disclosure of this patent document contains material which is subject to copyright protection. The copyright owner has no objection to the facsimile reproduction by anyone of the patent disclosure, as it appears in the Patent and Trademark Office patent files or records, but otherwise reserves all copyright rights whatsoever.

FIELD OF THE INVENTION

The present invention relates generally to gaming-related apparatuses, and more particularly, to gaming-related displays that present text and graphics that are viewable with a special visual aid, such as a camera phone.

BACKGROUND OF THE INVENTION

Gaming terminals, such as slot machines, video poker machines and the like, have been a cornerstone of the gaming industry for several years. Generally, the popularity of such machines among players is dependent in part on the intrinsic entertainment value of the machine relative to other available gaming options. The popularity of machines may be enhanced, for example, by employing more sophisticated and/or interactive audiovisual features.

SUMMARY OF THE INVENTION

To enhance a player's gaming experience, aspects of the present invention provide gaming-related displays that present text and graphics that are viewable with a special visual aid. The visual aid provides another interface that allows the player to further interact with, and be engaged by, a gaming machine and/or a gaming environment. The text and graphics shown on the visual aid may provide information that adds to player's experience. In general, the use of invisible light offers a feature that departs from the conventional gaming experience and attracts players.

According to one embodiment, a gaming system includes a gaming terminal for a wagering game. The gaming terminal includes a light-emitting area emitting a predetermined pattern of invisible light having wavelengths outside the visible electromagnetic spectrum. The gaming system also includes a visual aid including a sensor and a visual aid display. The visual aid detects, with the sensor, the pattern of invisible light, converts the pattern of invisible light into a pattern of visible light having wavelengths inside the visible electromagnetic spectrum, and displays the pattern of visible light on the visual aid display.

According to another embodiment, a gaming terminal for a wagering game includes a light-emitting area emitting a predetermined pattern of invisible light having wavelengths outside the visible electromagnetic spectrum. The pattern of invisible light provides at least one of text or graphics relating to the gaming terminal. The wavelengths of the invisible light correspond to wavelengths detectable by a visual aid allowing the visual aid to convert the pattern of invisible light into a pattern of visible light having wavelengths inside the visible electromagnetic spectrum and to display the pattern of visible light on a visual aid display.

According to yet another embodiment, a gaming environment includes at least one gaming terminal providing a wagering game. The gaming environment also includes a light-emitting area external to the at least one gaming terminal. The light-emitting area emits a predetermined pattern of invisible light having wavelengths outside the visible electromagnetic spectrum. The pattern of invisible light provides information from a gaming establishment. The pattern of invisible light is detectable by a visual aid. The visual aid converts the pattern of invisible light into a pattern of visible light having wavelengths inside the visible electromagnetic spectrum and displays the pattern of visible light on a visual aid display.

In some embodiments, the patterns of invisible light may include a pattern of infrared light. In addition, an example of a visual aid includes a camera phone that detects and displays the pattern of infrared light.

Additional aspects of the invention will be apparent to those of ordinary skill in the art in view of the detailed description of various embodiments, which is made with reference to the drawings, a brief description of which is provided below.

BRIEF DESCRIPTION OF THE DRAWINGS

FIG. 4D illustrates a further example of how invisible light may be employed to communicate information from a gaming machine, according to aspects of the present invention.

FIG. 4E illustrates an example of how information associated with the invisible light of FIG. 4D may be displayed, according to aspects of the present invention.

Figure 1:
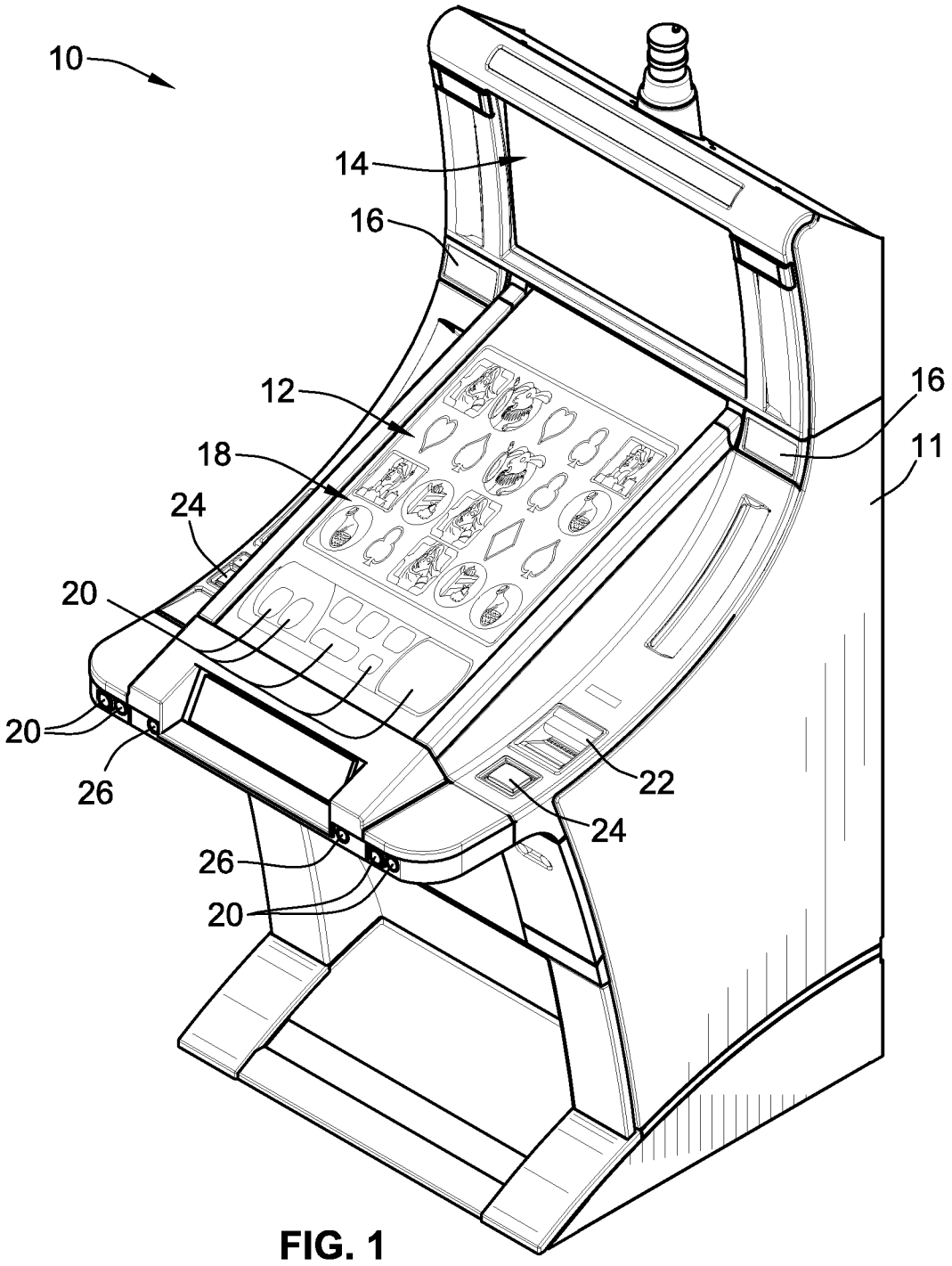
FIG. 1 illustrates an example free-standing gaming terminal according to aspects of the present invention.

While the invention is susceptible to various modifications and alternative forms, specific embodiments have been shown by way of example in the drawings and will be described in detail herein. It should be understood, however, that the invention is not intended to be limited to the particular forms disclosed. Rather, the invention is to cover all modifications, equivalents, and alternatives falling within the spirit and scope of the invention as defined by the appended claims.

DETAILED DESCRIPTION

While this invention is susceptible of embodiment in many different forms, there is shown in the drawings and will herein be described in detail preferred embodiments of the invention with the understanding that the present disclosure provides examples of the principles of the invention and is not intended to limit the broad aspect of the invention to the embodiments illustrated.

Referring to the drawings, wherein like reference numerals refer to like features throughout the several views, there is shown in FIG. 1 a representative gaming terminal 10 similar to those used in gaming establishments, such as casinos, hotels and cruise ships, and non-conventional gaming establishments, such as airports and restaurants. With regard to the present disclosure, the gaming terminal 10 may be any type of gaming terminal and may have varying structures and methods of operation. For example, in some aspects, the gaming terminal 10 is an electromechanical gaming terminal configured to play mechanical slots, whereas in other aspects, the gaming terminal is an electronic gaming terminal configured to play a video casino game, such as slots, keno, poker, blackjack, roulette, craps, etc. The gaming terminal 10 may take any suitable form, such as floor-standing models as shown, bartop models, workstation-type console models, etc. Further, the gaming terminal 10 may be primarily dedicated for use in conducting wagering games, or may include non-dedicated devices, such as mobile phones, personal digital assistants, personal computers, etc. Examples of gaming terminals are disclosed in U.S. Pat. No. 6,517,433, U.S. Patent Application Publication Nos. 2010/0062196 and 2010/0234099, and International Application No. PCT/US2007/000792, all of which are incorporated entirely herein by reference.

The gaming terminal 10 illustrated in FIG. 1 includes a cabinet 11 that may house various input devices, output devices, and input/output devices. By way of example, the gaming terminal 10 includes a primary display area 12, a secondary display area 14, and one or more audio speakers 16. The primary display area 12 or the secondary display area 14 may be a mechanical-reel display, a video display, or a combination thereof in which a transmissive video display is disposed in front of the mechanical-reel display to portray a video image superimposed upon the mechanical-reel display. The display areas may variously display information associated with wagering games, non-wagering games, community games, progressives, advertisements, services, premium entertainment, text messaging, emails, alerts, announcements, broadcast information, subscription information, etc. appropriate to the particular mode(s) of operation of the gaming terminal 10. The gaming terminal 10 includes a touch screen(s) 18 mounted over the primary or secondary areas, buttons 20 on a button panel, a bill validator 22, information reader/writer(s) 24, and player-accessible port(s) 26 (e.g., audio output jack for headphones, video headset jack, USB port, wireless transmitter/receiver, etc.). It should be understood that numerous other peripheral devices and other elements exist and are readily utilizable in any number of combinations to create various forms of a gaming terminal in accord with the aspects of the present invention.

Input devices, such as the touch screen 18, buttons 20, a mouse, a joystick, a gesture-sensing device, a voice-recognition device, and a virtual input device, accept player input(s) and transform the player input(s) to electronic data signals indicative of the player input(s), which correspond to an enabled feature at a time of activation (e.g., pressing a "Max Bet" button or soft key to indicate a player's desire to place a maximum wager to play the wagering game). The input(s), once transformed into electronic data signals, are output to a CPU for processing. The electronic data signals may include an electrical current, an electrical voltage, an electrical charge, an optical signal, an optical element, a magnetic signal, a magnetic element, or any combination thereof.

Figure 2:
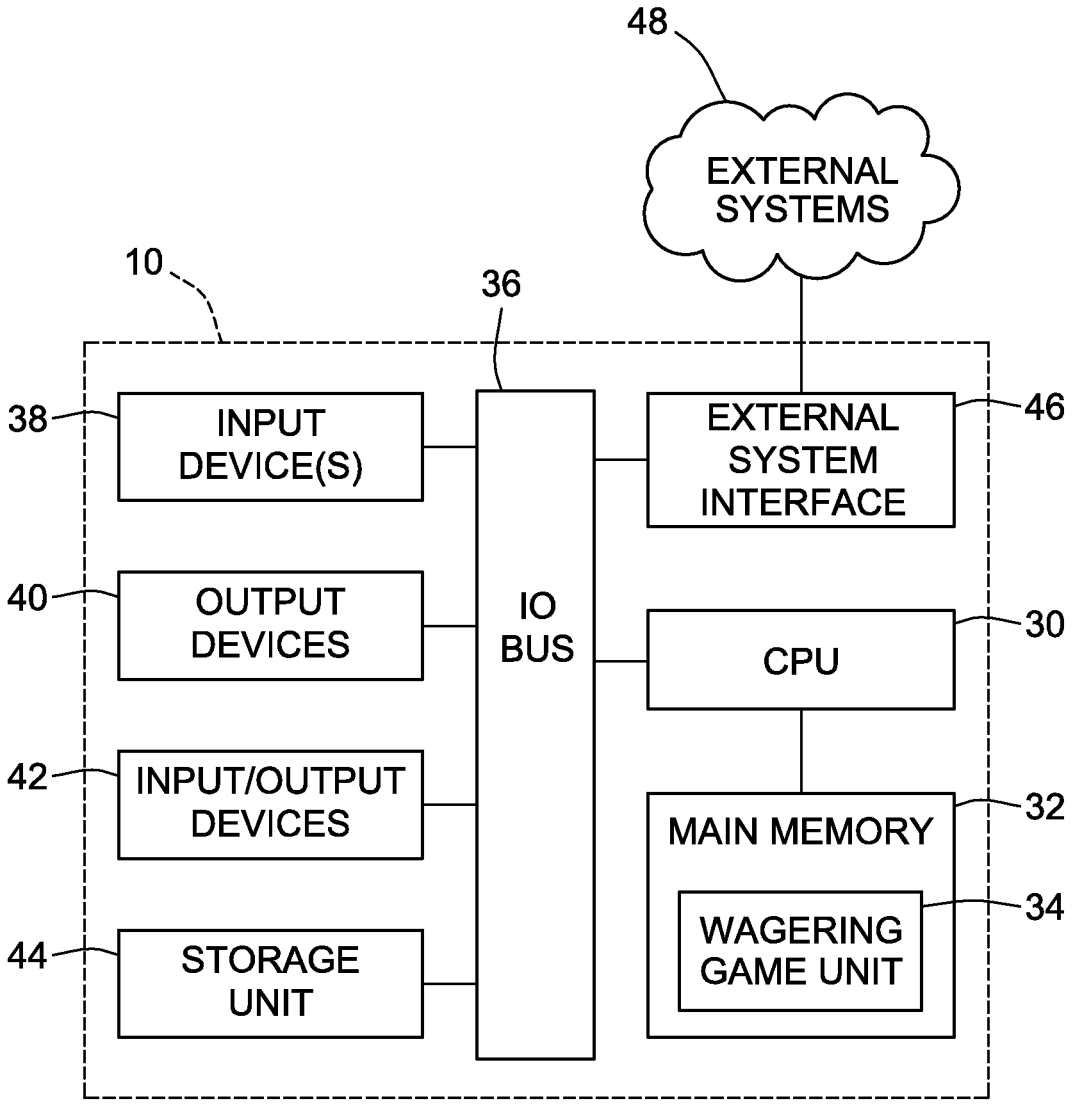
FIG. 2 illustrates a schematic view of a gaming system.

Turning now to FIG. 2, there is shown a block diagram of the gaming-terminal architecture. The gaming terminal 10 includes a central processing unit (CPU) 30 connected to a main memory 32. The CPU 30 may include any suitable processor(s), such as those made by Intel and AMD. By way of example, the CPU 30 includes a plurality of microprocessors including a master processor, a slave processor, and a secondary or parallel processor. CPU 30, as used herein, comprises any combination of hardware, software, or firmware disposed in or outside of the gaming terminal 10 that is configured to communicate with or control the transfer of data between the gaming terminal 10 and a bus, another computer, processor, device, service, or network. The CPU 30 comprises one or more controllers or processors and such one or more controllers or processors need not be disposed proximal to one another and may be located in different devices or in different locations. The CPU 30 is operable to execute all of the various gaming methods and other processes disclosed herein. The main memory 32 includes a wagering game unit 34. In one embodiment, the wagering game unit 34 may present wagering games, such as video poker, video black jack, video slots, video lottery, etc., in whole or part.

The CPU 30 is also connected to an input/output (I/O) bus 36, which can include any suitable bus technologies, such as an AGTL+ frontside bus and a PCI backside bus. The I/O bus 36 is connected to various input devices 38, output devices 40, and input/output devices 42 such as those discussed above in connection with FIG. 1. The I/O bus 36 is also connected to storage unit 44 and external system interface 46, which is connected to external system(s) 48 (e.g., wagering game networks).

The external system 48 includes, in various aspects, a gaming network, other gaming terminals, a gaming server, a remote controller, communications hardware, or a variety of other interfaced systems or components, in any combination. In yet other aspects, the external system 48 may include a player's portable electronic device (e.g., cellular phone, electronic wallet, etc.) and the external system interface 46 is configured to facilitate wireless communication and data transfer between the portable electronic device and the CPU 30, such as by a near-field communication path operating via magnetic-field induction or a frequency-hopping spread spectrum RF signals (e.g., Bluetooth, etc.).

The gaming terminal 10 optionally communicates with the external system 48 such that the terminal operates as a thin, thick, or intermediate client. In general, a wagering game includes a RNG (random number generator) for generating a random number, game logic for determining the outcome based on the randomly generated number, and game assets (e.g., art, sound, etc.) for presenting the determined outcome to a player in an audio-visual manner. The RNG, game logic, and game assets are contained within the gaming terminal 10 ("thick client" gaming terminal), the external system 48 ("thin client" gaming terminal), or are distributed therebetween in any suitable manner ("intermediate client" gaming terminal).

The gaming terminal 10 may include additional peripheral devices or more than one of each component shown in FIG. 2. Any component of the gaming terminal architecture may include hardware, firmware, or tangible machine-readable storage media including instructions for performing the operations described herein. Machine-readable storage media includes any mechanism that stores information and provides the information in a form readable by a machine (e.g., gaming terminal, computer, etc.). For example, machine-readable storage media includes read only memory (ROM), random access memory (RAM), magnetic disk storage media, optical storage media, flash memory, etc.

Figure 3:
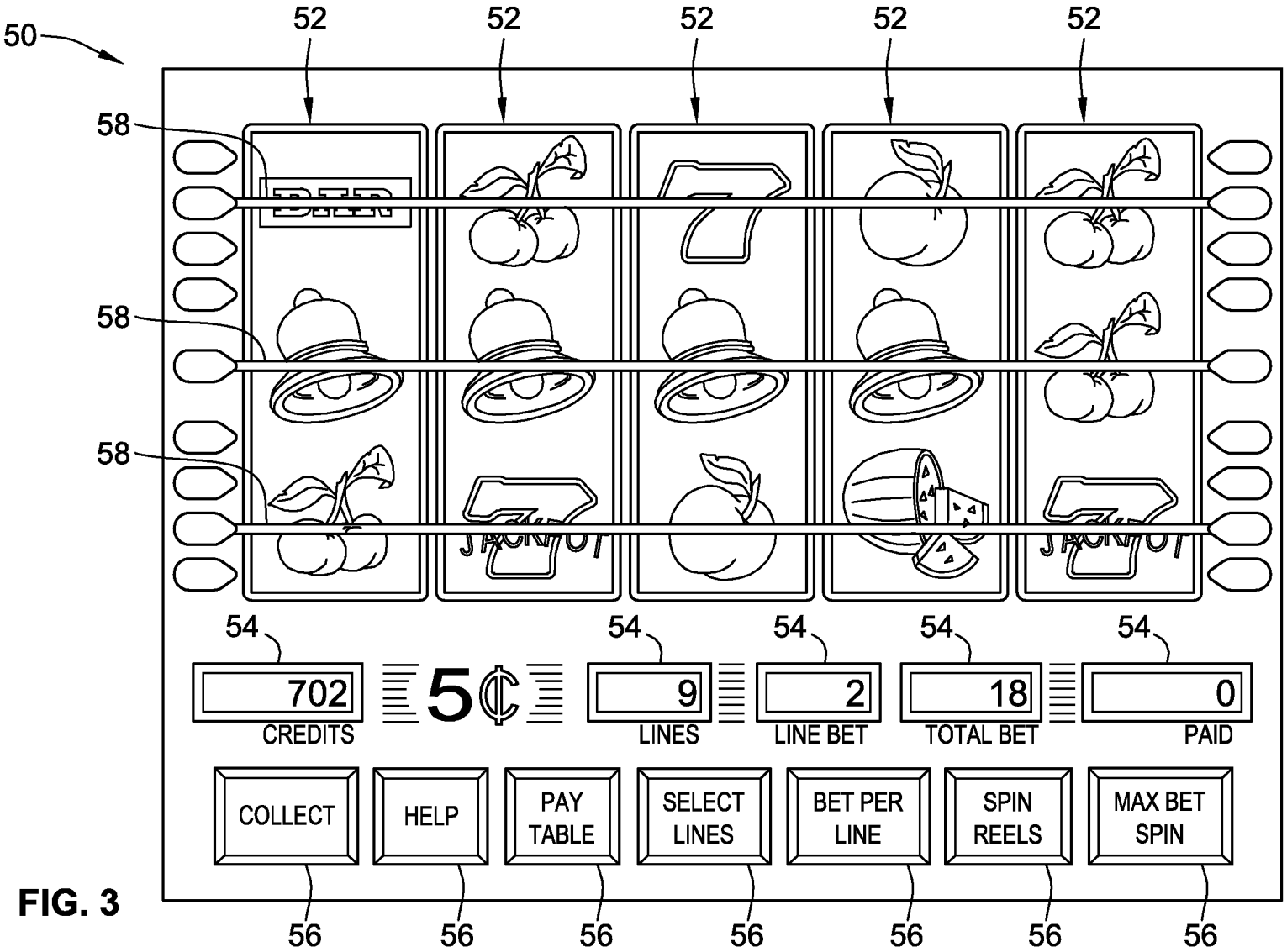
FIG. 3 illustrates an image of an exemplary basic-game screen of a wagering game displayed on a gaming terminal.

Referring now to FIG. 3, there is illustrated an image of a basic-game screen 50 adapted to be displayed on the primary display area 12 or the secondary display area 14. The basic-game screen 50 portrays a plurality of simulated symbol-bearing reels 52. Alternatively or additionally, the basic-game screen 50 portrays a plurality of mechanical reels or other video or mechanical presentation consistent with the game format and theme. The basic-game screen 50 also advantageously displays one or more game-session credit meters 54 and various touch screen buttons 56 adapted to be actuated by a player. A player can operate or interact with the wagering game using these touch screen buttons or other input devices such as the buttons 20 shown in FIG. 1. The CPU operate(s) to execute a wagering game program causing the primary display area 12 or the secondary display area 14 to display the wagering game.

In response to receiving a wager, the reels 52 are rotated and stopped to place symbols on the reels in visual association with paylines, such as paylines 58. The wagering game evaluates the displayed array of symbols on the stopped reels and provides immediate awards and bonus features in accordance with a pay table. The pay table may, for example, include "line pays" or "scatter pays." Line pays occur when a predetermined type and number of symbols appear along an activated payline, typically in a particular order such as left to right, right to left, top to bottom, bottom to top, etc. Scatter pays occur when a predetermined type and number of symbols appear anywhere in the displayed array without regard to position or paylines. Similarly, the wagering game may trigger bonus features based on one or more bonus triggering symbols appearing along an activated payline (i.e., "line trigger") or anywhere in the displayed array (i.e., "scatter trigger"). The wagering game may also provide mystery awards and features independent of the symbols appearing in the displayed array.

In accord with various methods of conducting a wagering game on a gaming system, the wagering game includes a game sequence in which a player makes a wager and a wagering game outcome is provided or displayed in response to the wager being received or detected. The wagering game outcome is then revealed to the player in due course following initiation of the wagering game. The method includes the acts of conducting the wagering game using a gaming apparatus, such as the gaming terminal 10 depicted in FIG. 1, following receipt of an input from the player to initiate the wagering game. The gaming terminal 10 then communicates the wagering game outcome to the player via one or more output devices (e.g., primary display 12 or secondary display 14) through the display of information such as, but not limited to, text, graphics, static images, moving images, etc., or any combination thereof. In accord with the method of conducting the wagering game, the CPU transforms a physical player input, such as a player's pressing of a "Spin Reels" touch key, into an electronic data signal indicative of an instruction relating to the wagering game (e.g., an electronic data signal bearing data on a wager amount).

For each data signal, the CPU (e.g., CPU 30) is configured to process the electronic data signal, to interpret the data signal (e.g., data signals corresponding to a wager input), and to cause further actions associated with the interpretation of the signal in accord with computer instructions. As one example, the CPU causes the recording of a digital representation of the wager in one or more storage media (e.g., storage unit 44), the CPU, in accord with associated computer instructions, causing the changing of a state of the storage media from a first state to a second state. This change in state is, for example, effected by changing a magnetization pattern on a magnetically coated surface of a magnetic storage media or changing a magnetic state of a ferromagnetic surface of a magneto-optical disc storage media, a change in state of transistors or capacitors in a volatile or a non-volatile semiconductor memory (e.g., DRAM), etc. The second state of the data storage media includes storage in the storage media of data representing the electronic data signal from the CPU (e.g., the wager in the present example). As another example, the CPU further, in accord with the execution of the instructions relating to the wagering game, causes the primary display 12, other display device, or other output device (e.g., speakers, lights, communication device, etc.) to change from a first state to at least a second state, wherein the second state of the primary display comprises a visual representation of the physical player input (e.g., an acknowledgment to a player), information relating to the physical player input (e.g., an indication of the wager amount), a game sequence, an outcome of the game sequence, or any combination thereof, wherein the game sequence includes acts described herein. The execution of computer instructions relating to the wagering game is further conducted in accord with a random outcome (e.g., determined by a RNG) that is used by the CPU to determine the outcome of the game sequence, using a game logic for determining the outcome based on the randomly generated number. In at least some aspects, the CPU is configured to determine an outcome of the game sequence at least partially in response to the random parameter.

In some cases, the gaming terminal 10 may employ a programmable random number generator (PRNG), which gives the player the option of providing a seed for the generation of a random number that determines an outcome of the wagering game. This feature gives the player perceived control/influence over the outcome of the wagering game. The player can elect to reseed the PRNG at any time, for example, when the player feels that his/her luck has run out or wants to change his/her luck. In reality, however, the random outcomes from the PRNG should generally be similar to results from a conventional RNG which does not use a seed from the player. The player provides the seed via an input interface. In one example, the PRNG input interface includes a camera on the gaming machine that takes a picture of a player, another person, or object (e.g., a good luck charm, such as a lucky rabbit's foot, etc.). The picture taken by the camera is then translated into a seed for the PRNG via a checksum or MD5 hash of the picture. In a second example, the input interface includes a touch screen, which the player touches or contacts in a manner determined by the player. The seed is then generated according to the sequence of touches on the screen, the particular pattern created on the screen, the amount of contact time, the screen coordinates contacted, etc. It is contemplated, however, that any type of input can be employed as long as the input can be converted into a seed for the PRNG. In alternative embodiments, the player is allowed to provide an input merely for perceived control/influence, but a new seed is not actually generated and the random number generation function continues unchanged.

As described previously, the gaming terminal 10 includes a primary display area 12 and a secondary display area 14, which display information appropriate to the particular mode (s) of operation of the gaming terminal 10. A typical human eye, without any special visual aids, responds to light having wavelengths in the range of approximately 390 nm to approximately 750 nm in the electromagnetic spectrum. These wavelengths are also referred to as the visible spectrum. As used herein, the term "visible light" refers to light that has wavelengths substantially in the visible spectrum and that are generally detectable by the typical human eye without the use of special visual aids. To make text and graphics detectable by the unaided human eye, displays on conventional gaming machines generally emit and/or reflect visible light. Likewise, the display areas 12 and 14 of the gaming terminal 10 present information via visible light.

According to further aspects of the present invention, however, the display areas 12 and 14 as shown in FIGS. 4A-E also present additional information by emitting patterns of light that have wavelengths in a predetermined range outside the visible spectrum. As used herein, the term "invisible light" refers to light that has predetermined wavelengths outside the visible spectrum and that are generally not detectable by the typical human eye without the use of special visual aids. As FIGS. 4A-E illustrate, a visual aid 100 detects the patterns of invisible light and presents the patterns on a display 112 via visible light. Thus, according to aspects of the present invention, embodiments communicate information to people in a gaming environment via invisible light that is detected by a visual aid.

The displays 12 and 14, or example, may communicate information by emitting patterns of light with infrared (IR) wavelengths, which fall in the range of approximately 750 nm to approximately 300 μm in the electromagnetic spectrum. Correspondingly, the visual aid 100 detects IR light from the displays 12 and 14 and displays text and graphics formed by the patterns of IR light on the display 112 via visible light. For example, the visual aid 100 may detect and display the patterns of IR light as visible red light on the display 112.

Figure 4A:
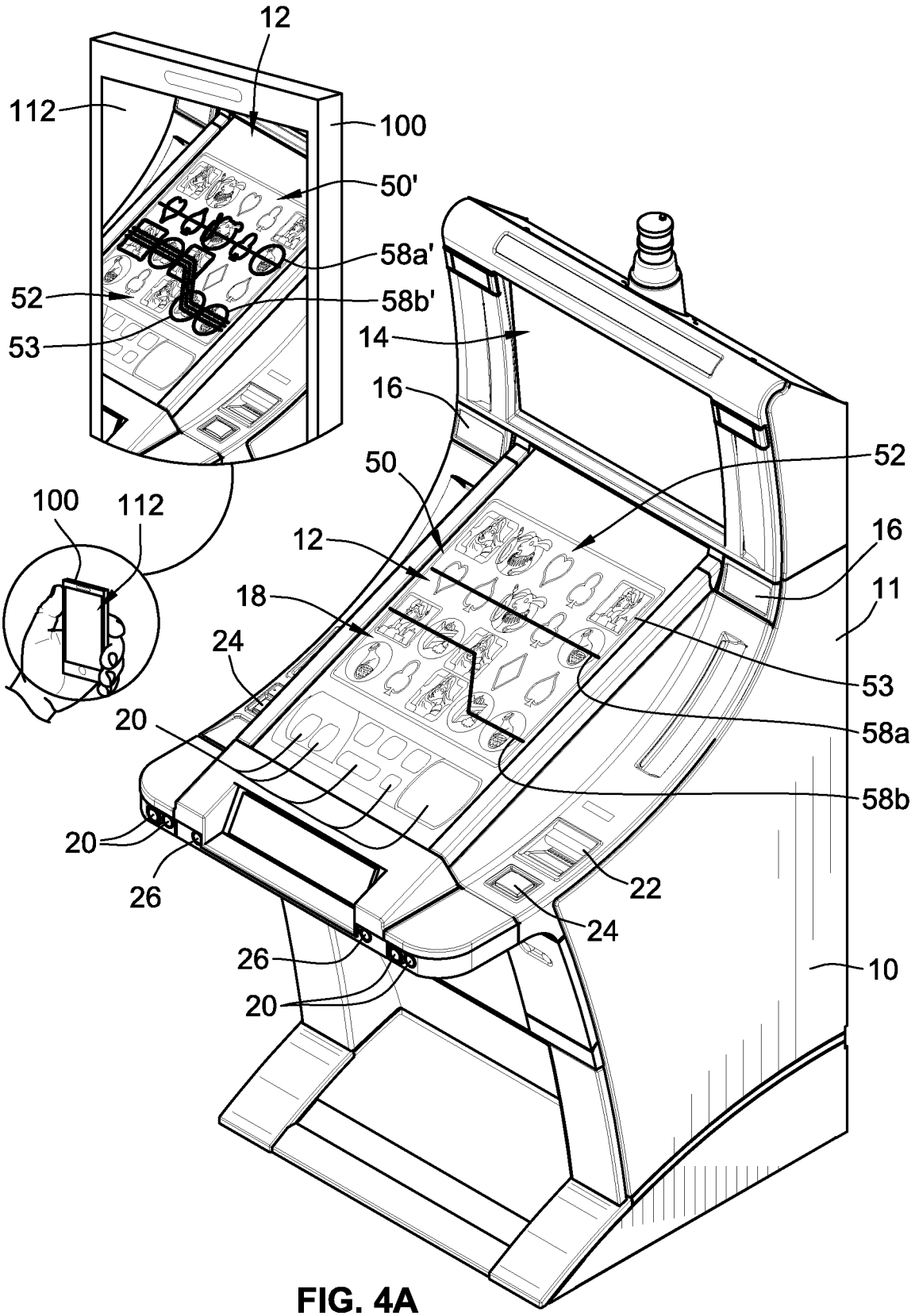
FIG. 4A illustrates an example of how invisible light may be employed to communicate information from a gaming machine, according to aspects of the present invention.

FIGS. 4A-E illustrate different examples of how invisible light may be employed to communicate information from the gaming machine 10. As shown in the example of FIG. 4A, the primary display area 12 presents the basic-game screen 50 which includes a plurality of symbol-bearing reels 52. In response to receiving a wager, the reels 52 are rotated and stopped to place the symbols 53 on the reels 52 in an arrangement that is evaluated for one or more winning outcomes. Because the reel symbols 53 are presented via visible light, the player can see the resulting arrangement of reel symbols 53 without using the visual aid 100. If the reels 52 are mechanical reels, the mechanical reels reflect ambient light and/or light from a specific light source. The reflection produces a pattern of visible light, which a player detects and recognizes as mechanical reels and a corresponding arrangement of reel symbols. Alternatively, if the reels 52 are simulated as a video, the primary display area 12 also emits visible light according to patterns that simulate the appearance of mechanical reels.

In the specific example shown in FIG. 4A, the resulting arrangement of reel symbols 53 produces two winning outcomes. In particular, the basic-game screen 50 presents paylines 58*a* and 58*b* to identify respective symbol combinations that yield the winning outcomes. The paylines 58*a* and 58*b* are also presented with visible light, so that the player can identify the winning combinations of reel symbols 53 without the use of the visual aid 100.

As described above, however, the visual aid 100 allows the gaming terminal 10 to present additional text and graphics with invisible light. As shown in FIG. 4A, the visual aid 100 captures and displays an image of the primary display area 12 on the display 112. The image of the primary display area 12 includes an image 50' of the basic-game screen 50. Because the visual aid 100 also detects visible light, the reels 52 and their symbols 53 are shown in the image 50' on the display 112. The image 50', however, also includes additional graphics 58*a*' and 58*b*', which the basic-game screen 50 presents with invisible light, e.g., IR light. Although the graphics 58*a*' and 58*b*' are not visible when directly viewing the primary display area 12, the visual aid 100 can be employed to detect the graphics 58*a*' and 58*b*' and present them via the display 112 with visible light.

As FIG. 4A illustrates, the graphics 58*a*' and 58*b*' further highlight the paylines 58*a* and 58*b*. In particular, the graphics 58*a*' and 58*b*' provide illuminated outlines of the reel symbols 53 along the paylines 58*a* and 58*b*, respectively. The outlines may, for example, cause the particular symbols 53 to glow or appear to fluoresce. The graphics 58*a*' and 58*b*', however, may provide more ornate or sophisticated designs and/or animated effects. In addition, the graphics 58*a*' and 58*b*' may be combined with text and other types of graphics. For example, the design of the graphics 58*a*' and 58*b*' may be consistent with the overall theme of the wagering game. Moreover, the graphics 58*a*' and 58*b*' may be static or may be dynamic, i.e., change over time. For example, the illuminated outlines shown in FIG. 4A may flash on and off in an animated manner, where the visual aid 100 can show video-like images of the graphics 58*a*' and 58*b*' as they change over time.

The use of invisible light and the visual aid 100 enhances the player's experience by providing an additional way for the player to interact individually with the gaming terminal 10. In the example of FIG. 4A, the graphics 58*a*' and 58*b*' highlight the fact that the player has achieved winning outcomes and adds to the excitement of playing the wagering game. In general, the use of invisible light in the embodiments described herein offer a novelty that departs from the conventional gaming experience and attracts players.

Figure 4B:
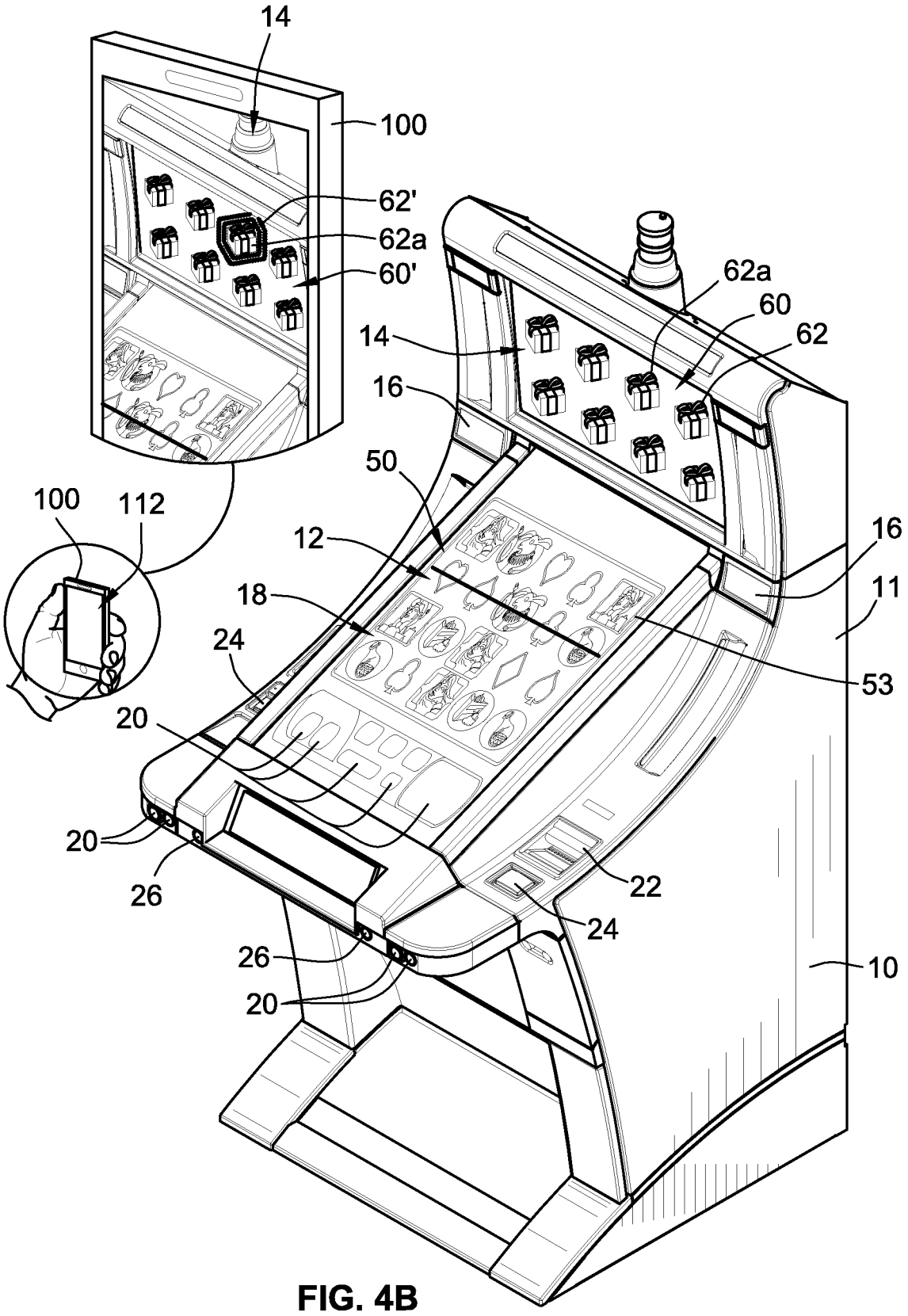
FIG. 4B illustrates another example of how invisible light may be employed to communicate information from a gaming machine, according to aspects of the present invention.

FIG. 4B illustrates another example of how invisible light is employed to enhance the wagering game on the gaming machine 10. The secondary display area 14 presents a bonus-game screen 60 for a bonus game on the gaming terminal 10. For example, the bonus game can be triggered by the appearance of one or more predetermined reel symbols 53 in the basic-game screen 50. In particular, the bonus-game screen 60 includes a plurality of selectable elements 62 for a picking game, e.g., shown as unopened gift boxes in FIG. 4B. In the bonus picking game, the player selects one or more of the selectable elements 62. In response to picking a particular selectable element 62, the bonus game reveals an outcome for the particular selectable element 62. For example, the player may receive an award, e.g., credits, award multipliers, etc., for picking a particular selectable element 62. The player may accumulate several awards over a series of picks. In some cases, the player may be limited to a certain number of picks, e.g., three picks. In other cases, the player continues to pick selectable elements until one of the picks reveals a terminating outcome that ends the bonus game. The bonus-game screen 60 presents the selectable elements 62 and reveals their corresponding outcomes with visible light, so the player can play the bonus game by directly viewing the secondary display area 14.

In the example of FIG. 4B, however, the bonus-game screen 60 also uses invisible light to provide a hint that may aid the player while playing the bonus picking game. As shown in FIG. 4B, the visual aid 100 captures and displays an image of the secondary display area 14 on the display 112. The image of the secondary display area 14 includes an image 60' of the basic-game screen 60. The image 60' includes an additional graphic 62*a*', which the basic-game screen 60 presents with invisible light, e.g., IR light. In particular, the graphic 62*a*' highlights one of the selectable elements 62*a* by providing an illuminated outline. The graphic 62*a*', however, may provide more ornate or sophisticated designs and/or animated effects. In addition, the graphic 62*a*' may be combined with text and other graphics. For example, the design of the graphic 62*a*' may be consistent with the overall theme of the wagering game. Moreover, the graphic 62*a*' may be static or may be dynamic, i.e., change over time. For example, the illuminated outlines shown in FIG. 4B may flash on and off in an animated manner, where the visual aid 100 can show video-like images of the graphic 62*a*' as it changes over time.

The graphic 62*a*' signals some information about the highlighted selectable element 62*a*. For example, the graphic 62*a*' may indicate that the highlighted selectable element 62*a*, if picked by the player, will provide the player with a particular type of award, e.g., a minimum credit amount, a minimum multiplier, etc. In another example, the graphic 62*a*' may indicate that the highlighted selectable element 62*a*, if picked, will not end result in a terminating outcome. Alternatively, the graphic 62*a*' may indicate that the highlighted selectable element 62*a*, if picked, will result in a terminating outcome. In yet another example, the graphic 64' may indicate that the highlighted selectable element 62*a* is a special "high risk/high reward" selection, e.g., it provides a relatively large award or results in wiping out all awards won in the bonus game. Accordingly, the use of invisible light and the visual aid 100 gives the player interactive access to information that enhance the experience of playing the bonus picking game. The use of the invisible light also gives the hint a sense of secrecy, which gives the impression that the hint is provided especially for the player. As such, the gaming machine 10 may provides the player with a more engaging gaming experience.

In addition to providing information to the player during the bonus picking game, other embodiments may also provide information with invisible light after the bonus picking game is completed. For example, at the end of the bonus picking game, the bonus-game screen 60 may reveal the outcomes that are associated with each of the unpicked selectable elements 62, e.g., what awards the player could have otherwise picked. Rather than revealing this information with visible light, the bonus-game screen 60 may present this information with invisible light, so that the player can only obtain this information by employing the visual aid 100.

Figure 4C:
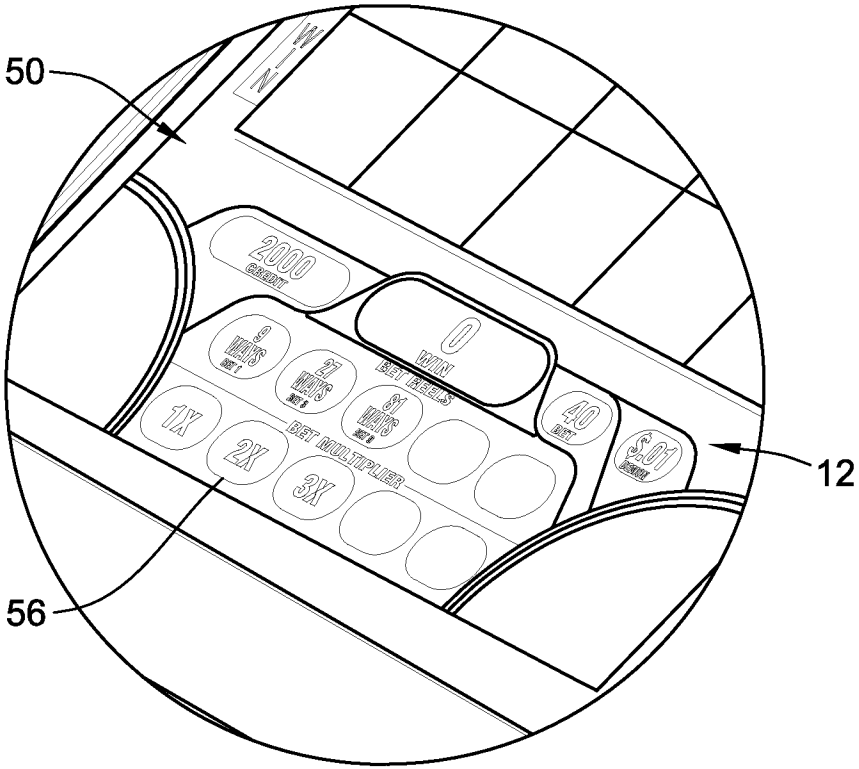
FIG. 4C illustrates a yet another further example of how invisible light may be employed to communicate information from a gaming machine, according to aspects of the present invention.
Figure 4C:
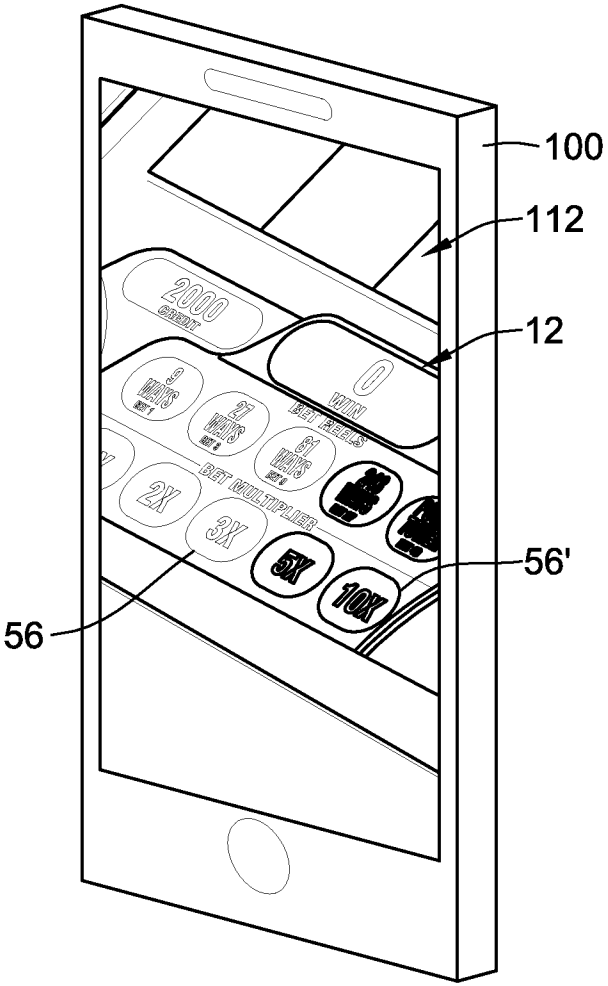

As described previously, the basic-game screen 50 in the primary display area 12 includes various touch screen buttons 56 adapted to be actuated by a player. A player can operate or interact with the wagering game using these touch screen buttons 56. As shown in FIG. 4C, the basic-game screen 50 presents several touch screen buttons 56 with visible light, so the player can identify these touch screen buttons by directly viewing the primary display area 12. The basic-game screen 50, however, also uses invisible light to present additional touch screen buttons 56', which provide additional functionality. As shown in FIG. 4C, the visual aid 100 displays an image of the primary display area 12 on the display 112. The image of the primary display area 12 includes an image 50' of the basic-game screen 50. The image 50' includes the additional touch screen buttons 56', which the visual aid 100 displays with visible light. By revealing the touch screen buttons 56', the visual aid 100 makes the player aware of additional functionality that would not otherwise be apparent. As shown in FIG. 4C, the touch screen buttons 56 on the basic-game screen 50 allow the player to select how many paylines to play and how much to wager in the basic game. The touch screen buttons 56' made visible by the visual aid 100, however, enhances the experience of playing the basic game by revealing additional payline and wager options.

The embodiments of FIGS. 4A-C demonstrate different ways to present additional information by emitting patterns of invisible light that are detectable by the visual aid 100. According to some embodiments, the visual aid 100 acts as a digital camera to capture images of patterns of invisible light in addition to images of visible light. The visual aid 100 receives the visible and invisible light through a lens and focuses the light onto an electronic image sensor, which converts the light signals into digital signals. Images based on the digital signals are displayed on the display 112. In some embodiments, the display 112 can show images in substantially real time in video-like fashion.

The visual aid 100 may be a device that is specially manufactured to be used in combination with the gaming terminal 10. Although the visual aid 100 may be a handheld device as shown in FIGS. 4A-C, the visual aid 100 may be implemented according to other configurations. For example, the visual aid 100 may be configured as viewing glasses which are worn about the eyes.

Figure 5:
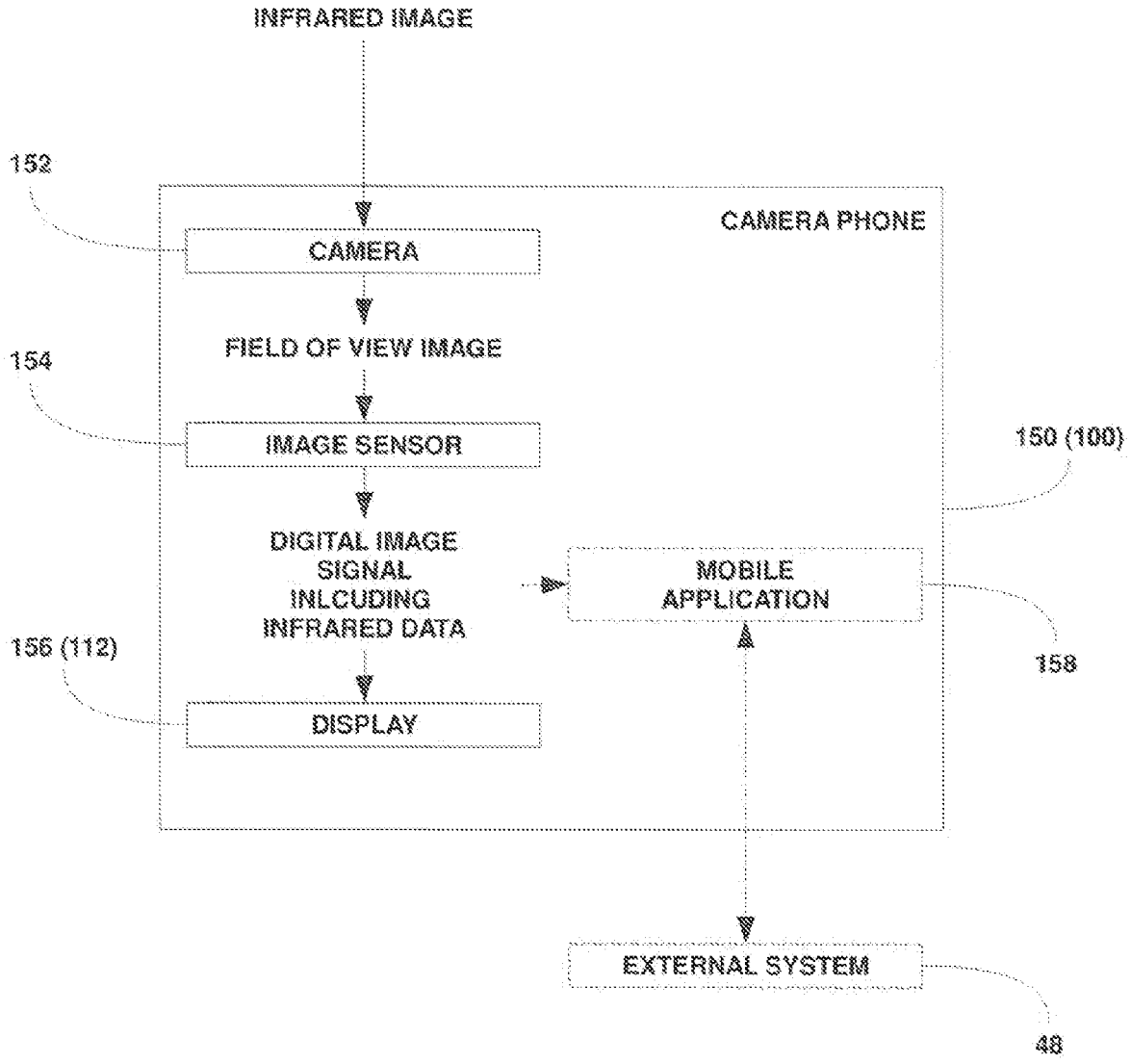
FIG. 5 illustrates an example visual aid that may be employed according to aspects of the present invention.

As illustrated in FIG. 5, the visual aid 100 may be a mobile phone 150 equipped with a camera 152 (camera phone). Most commercially available camera phones do not include filters that block infrared light. As a result, an electronic image sensor 154, e.g., a charge-coupled device (CCD), on the camera phone 150 can receive and convert infrared light into digital signals that can be seen on the display 156 of the camera phone 150. The display 156 here corresponds to the display 112 described herein. Often, the infrared light appears as purple-white shaded patterns on the camera phone display 156. Because camera phones are widely owned by consumers, allowing players to use their own camera phones as the visual aid 100 is a feasible alternative to distributing specially manufactured visual aids to the players. To allow such use of camera phones, the gaming machine 10 must generally employ patterns of infrared light when presenting information with invisible light.

Accordingly, FIG. 4D illustrates a further example of how invisible light is employed to enhance the wagering game on the gaming machine 10. The secondary display area 14 presents a background image 70 for a photograph that may be taken with a player who has won a large award, e.g., a jackpot. Here, the photograph may be taken by the camera phone 150. Some aspects of the background image 70 are presented with visible light, while other aspects are presented with invisible light. When viewing the background image 70 without the visual aid 100, only some of the information communicated by the secondary display 14, i.e., the words "WON $233, 422," can be detected. As shown in FIG. 4E, when an image 70' of the background image 70 is viewed through the visual aid 100, the display 112 shows all of the information communicated by the secondary display 14, i.e., the words "Joey Smith WON $233,422." While the player in FIGS. 4D and 4E might want his name in a photograph that he takes of himself and selectively shares with friends and family, he may not want his name to be more widely publicized with visible light from the secondary display 14. Thus, his name appears on the photograph but not easily to others. In some embodiments, the player may be identified by a player's card inserted into the machine and his name appears on the secondary display 14 with invisible light only as long as the player's card remains in the gaming machine 10. Accordingly, the player can control the display of his name and maintain some privacy, while the gaming establishment can continue to publicize the award won on the machine. In addition to displaying the player's name in the image 70', the secondary display 14 also presents the name 71 of the gaming establishment with invisible light, providing advertising for the gaming establishment when the picture is shared.

Figure 6A:
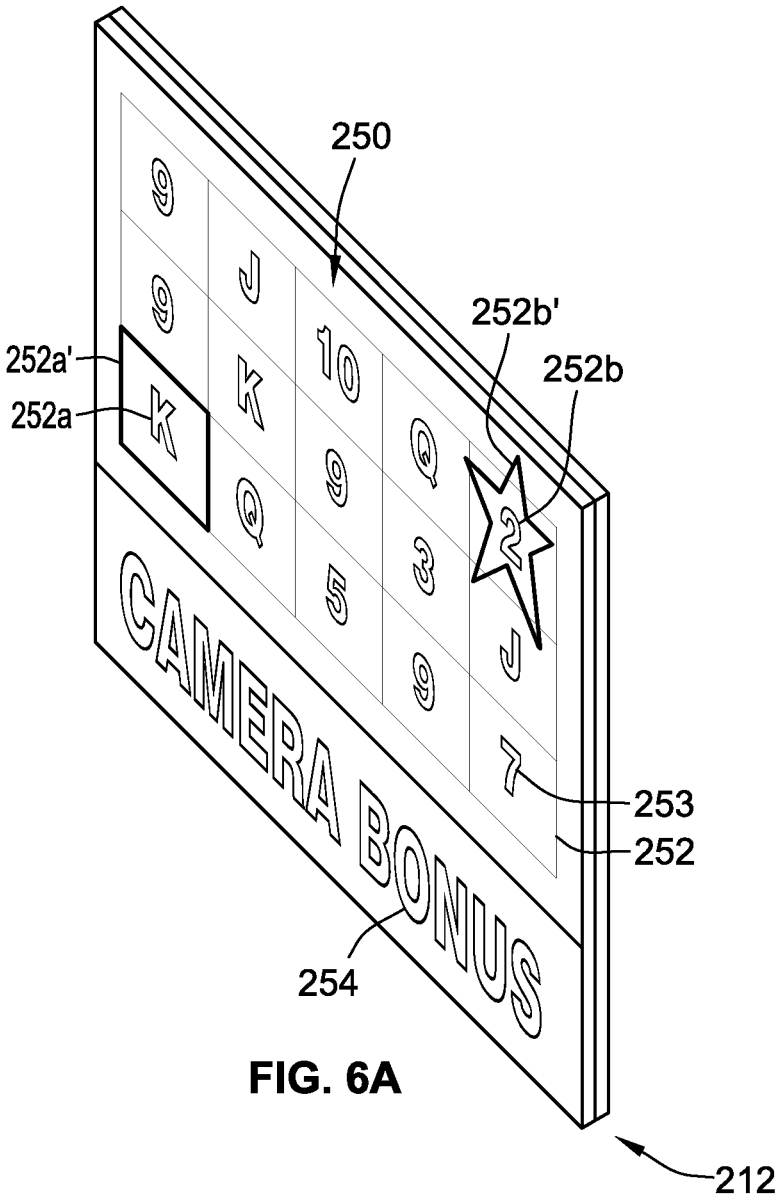
FIG. 6A illustrates an example gaming screen that includes text and graphics that are displayed with visible and invisible light according to aspects of the present invention.

FIG. 6A illustrates a display 212 that displays a gaming screen 250, which can be seen through the display 112 of the visual aid 100. The display 212 may correspond to the primary display area 12 or the secondary display area 14 of the gaming machine 10. The gaming screen 250 generally displays an array 252 with an arrangement of symbols 253. Aspects of the gaming screen 250 are shown with visible light, while other aspects are shown in invisible light. For example, the symbols 253 are generally shown with visible light. To highlight particular symbols 252*a* and 252*b* according to rules of a wagering game, the symbols 252*a* and 252*b* are highlighted with graphics 252*a*' and 252*b*', respectively. The graphics 252*a*' and 252*b*' are presented with invisible light and can only be seen with the visual aid 100. In addition, the gaming screen 250 also displays text 254, e.g., "CAMERA BONUS, with invisible light to emphasize the invisible light feature of the gaming machine.

Figure 6B:
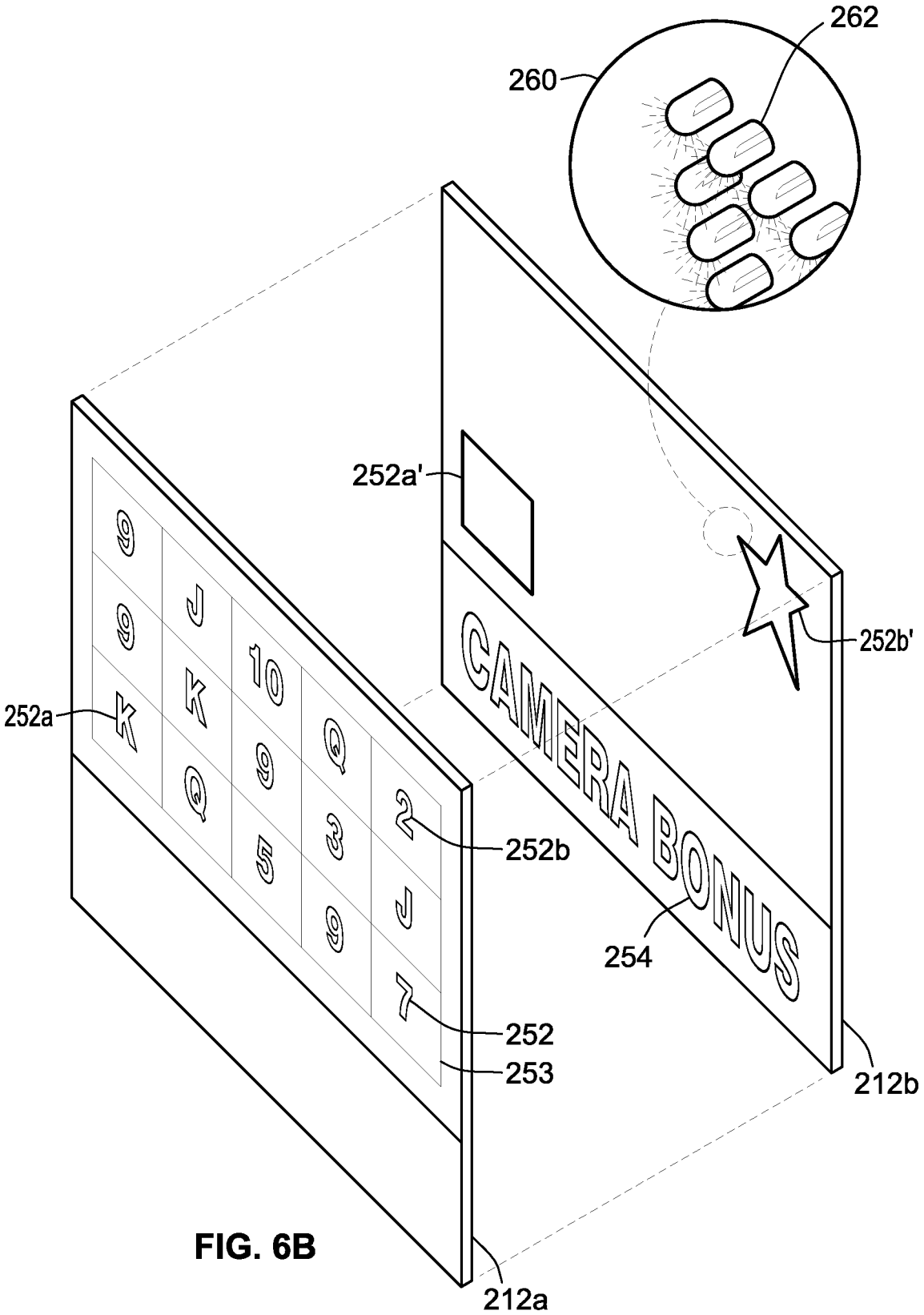
FIG. 6B illustrates an example display assembly that displays text and graphics with visible and invisible light according to aspects of the present invention.
Figure 6C:
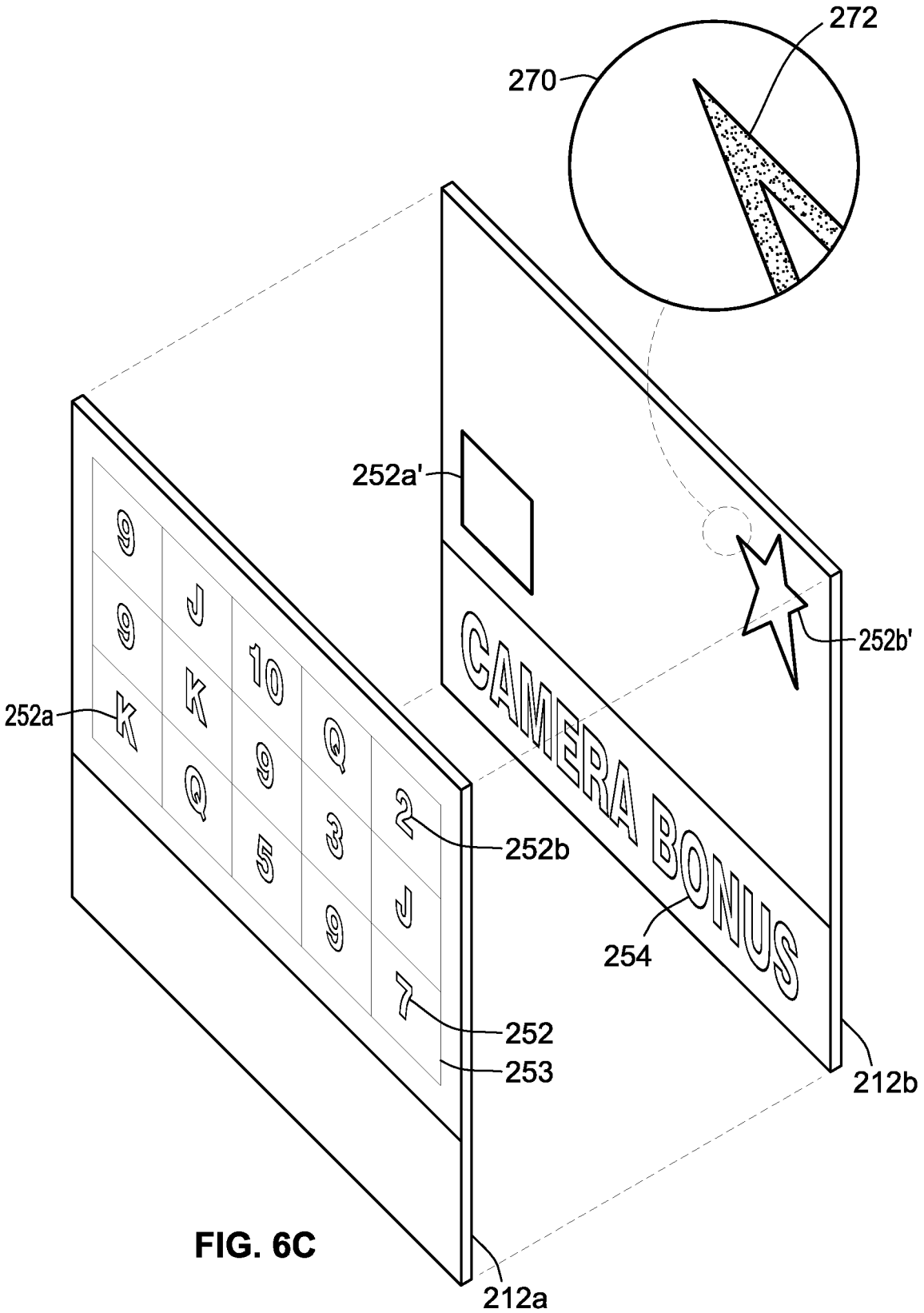
FIG. 6C illustrates another example display assembly that displays text and graphics with visible and invisible light according to aspects of the present invention.

Correspondingly, FIGS. 6B-C illustrate display assemblies that may be employed to produce the display 212 of FIG. 6A. The display assemblies include a subdisplay 212*a* which presents text and graphics with visible light and a subdisplay 212*b* which presents text and graphics with invisible light. The subdisplays 212*a* and 212*b* are combined to produce the display 212. Specifically, the subdisplays 212*a* and 212*b* are arranged so that their combination appears as the single display 212. In one example, the subdisplay 212*a* defines a plane disposed over a second plane defined by the subdisplay 212*b*, and the invisible light emitted by the subdisplay 212*b* can pass through the subdisplay 212*a*. It is contemplated, however, that the subdisplays 212*a* and 212*b* more generally exemplify and/or conceptually represent different aspects of the display 212 that emit visible and invisible light, respectively, regardless of their specific structures and relative arrangements.

According to one embodiment, FIG. 6B shows that patterns of invisible light may be emitted by the subdisplay 212*b* through an arrangement 260 of light emitting diodes (LED's) 262, e.g., infrared LED's. The LED's 262 can be individually activated and may function together in a manner similar to a dot matrix display. In the example of FIG. 6B, the LED's 262 may be arranged to provide illuminated shapes, e.g., rectangles, stars, etc., for each of the symbols 253. As such, the shape of LED's 262 for each symbol 253 can be selectively activated to highlight the symbols 253 according to aspects of the wagering game.

Alternatively or additionally, FIG. 6C shows that patterns of invisible light may be emitted by the subdisplay 212*b* with a liquid crystal display (LCD) 270, e.g., LCD with infrared sub-pixels. The LCD 270 includes areas that present shapes 272, e.g., rectangles, stars, etc., for each of the symbols 253. As such, the shapes 272 for each symbol 253 can be selectively activated to highlight the symbols 253 according to aspects of the wagering game. Because the LCD 270 can provide higher resolution than an arrangement 260 of LED's 262, however, the LCD 270 may be employed to present more complex or sophisticated forms of text and graphics.

According to one embodiment, the subdisplay 212*a* also includes a LCD with red, green, and blue sub-pixels (visible light). In this case, the subdisplay 212*a* and the subdisplay 212*b* may be combined to provide a single LCD plane with red, green, and blue sub-pixels and infrared sub-pixels. The backlight source on conventional LCD's do not generally emit IR light. As such, a special LCD may need to be produced, for example, by modifying a conventional LCD to emit IR light.

According to another embodiment, a special LCD may have a dual switchable backlight that alternatively emits white light (visible light) and IR light. The backlight is operated to switch between a first mode emitting white light (corresponding to the subdisplay 212*a*) and a second mode emitting IR light (corresponding to the subdisplay 212*b*). When the switching between the first and second modes occurs at a sufficiently high frequency, the LCD appears to emit both the white light and the IR light simultaneously. In one particular embodiment, the red sub-pixels of the LCD may be optimized to transmit IR light as well.

Figure 7A:
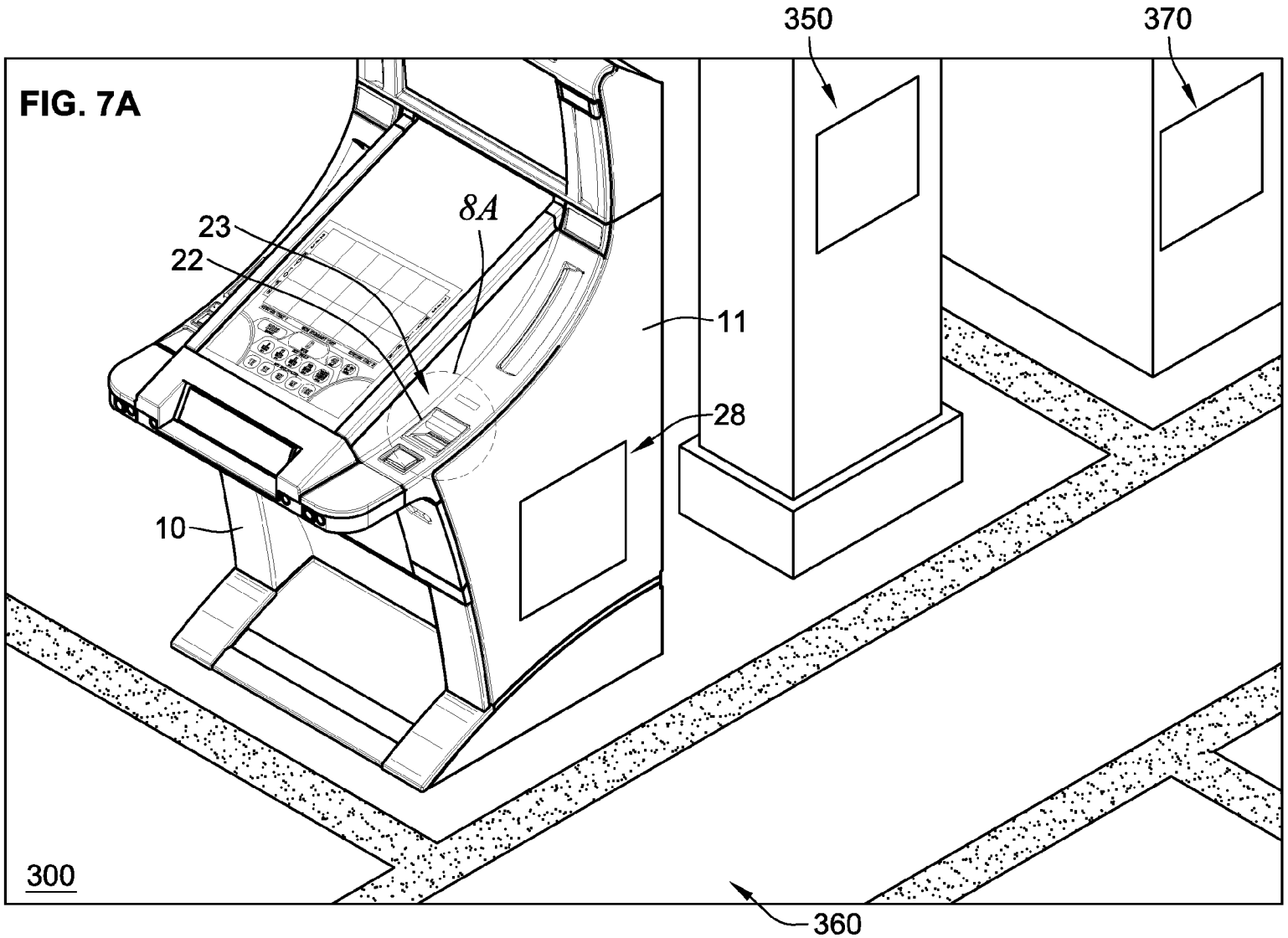
FIG. 7A illustrates an example gaming environment showing the text and graphics presented with visible light according to aspects of the present invention.
Figure 7B:
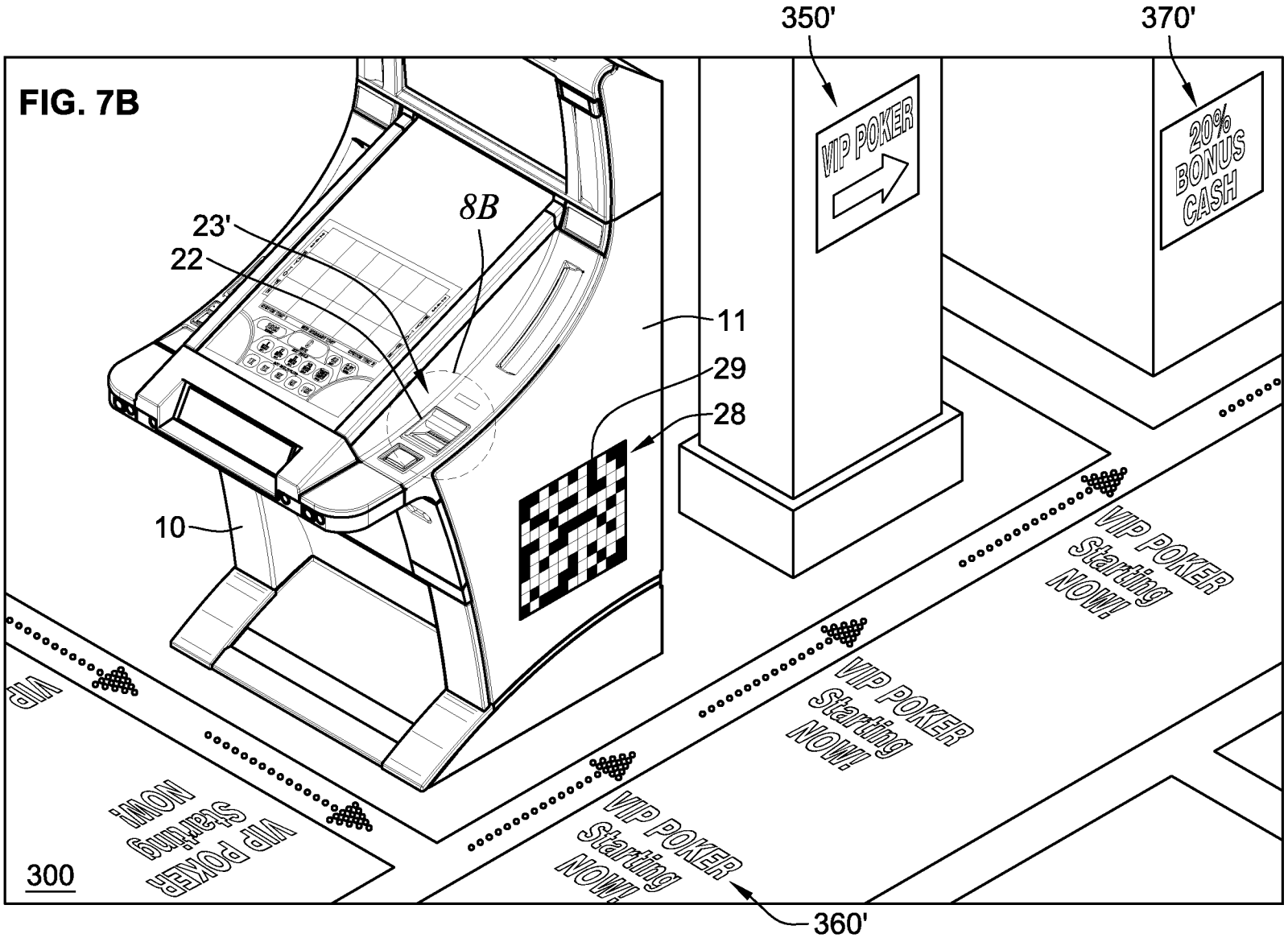
FIG. 7B displays the example gaming environment of FIG. 7A showing the text and graphics presented with both visible and invisible light according to aspects of the present invention.

The use of invisible light is not limited to display areas of a gaming machine. FIGS. 7A-B provide examples of how invisible light may be employed in aspects of a gaming environment 300. The gaming environment 300 includes all aspects of one or more gaming machines 10 as well as the areas, structures, furniture, surfaces, etc., around the one or more gaming machines 10. FIG. 7A illustrates aspects of the gaming environment 300 as they are seen according to visible light. Meanwhile, FIG. 7B illustrates the same aspects of the gaming environment 300 as they are seen according to visible and the invisible light as can be seen, for instance, through the display 112 of the visual aid 100.

Figure 8B:
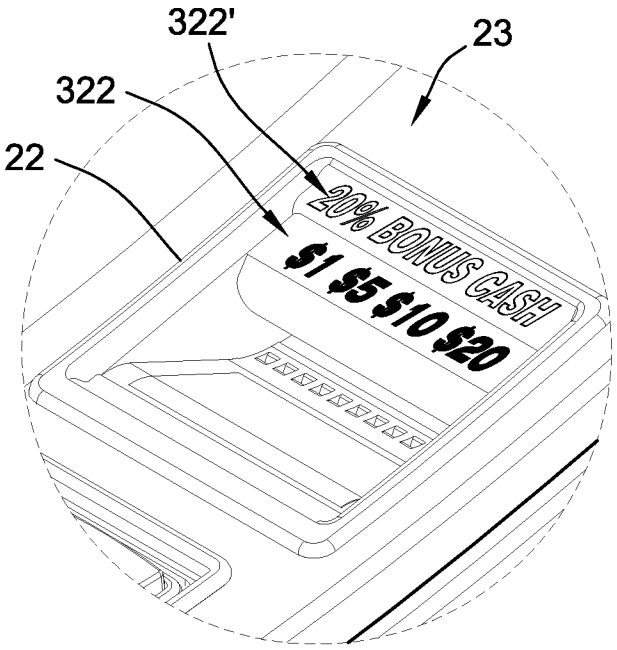
FIG. 8B illustrates an aspect of the gaming environment shown in FIG. 7B.
Figure 8A:
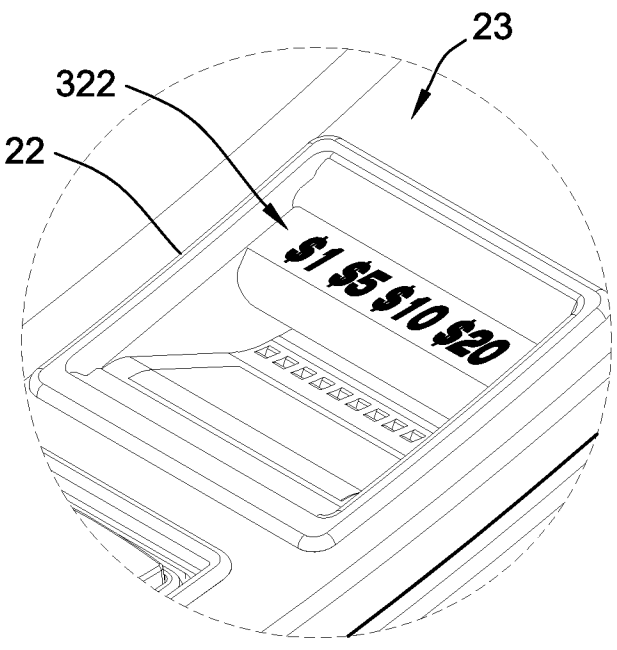
FIG. 8A illustrates an aspect of the gaming environment shown in FIG. 7A.

FIGS. 7A-B show that invisible light may be employed to present information from other parts of the gaming machine 10, i.e., other than the displays 12 and 14. FIGS. 7A-B illustrate an area 23 around the bill validator 22. The area 23 is shown in more detail in FIGS. 8A-B. The area 23 presents information that is not visible in FIG. 8A, but is visible in FIG. 8B. As FIG. 8A shows in particular, the area 23 presents text with visible light to indicate which currency denominations, e.g., "$1 $5 $10 $20," are accepted by the bill validator 22. As FIG. 8B shows, however, the area 23 presents text with invisible light to indicate that the player will receive bonus cash if the player inserts additional currency into the gaming machine 10, e.g., via the bill validator 22. In the illustrated example, the player will receive an additional credit equal to 20% of the amount of currency inserted into the gaming machine 10 when the area 23 displays "20% BONUS CASH" in invisible light. The bonus cash, for instance, may be awarded for a limited time when a particular predetermined event occurs during the basic game and/or bonus game. Alternatively or additionally, the bonus cash may be awarded when the gaming machine 10 determines that the player has achieved a particular status or has a sufficient number of loyalty points, e.g., by reading a player's card inserted into the information reader/writer 24 in the gaming machine 10. In any event, the player only knows about the bonus cash opportunity by employing the visual aid 100, which can detect the invisible light and present the bonus cash information on the display 112 with visible light.

As a further example, an area 28 on the cabinet 11 of the gaming machine 10 presents information that is not visible in FIG. 7A, but is visible in FIG. 7B. As FIG. 7A shows in particular, the area 28 does not present any information with visible light. As FIG. 7B shows, however, the area 28 presents, with invisible light, a two-dimensional matrix barcode 29, e.g., a Quick Response (QR) Code. Although other types of barcodes, e.g., Universal Product Code (UPC) barcodes, and other computer-readable symbols may be employed, two-dimensional matrix barcodes may be advantageous due to their fast readability and large storage capacity. Using invisible light allows such symbols to be presented in an unobtrusive manner.

The two-dimensional matrix barcode 28 may be detected with the visual aid 100 and used as input for an software application installed on the visual aid 100, i.e., as computer-readable instructions stored on storage media and executed by processing hardware. For instance, the two-dimensional matrix barcode 28 may provide an identifier for some aspect of the gaming machine 10 which can be used to provide additional information to the player through the software application and display 112. The information presented by the visual aid 100 may be stored directly in the two-dimensional matrix barcode 28, or the two-dimensional matrix barcode 28 may be employed by the software application as an identifier to access other (external) information sources, e.g., web pages on the Internet, networked databases, etc., for presentation on the display 112. By providing access to other information sources, changing information can be dynamically provided for a given two-dimensional matrix barcode 28.

The software application, for example, may be related to an account the player may have with a gaming establishment, e.g., for a loyalty program. The software application may be employed to receive and/or update data in the player's account. For example, the player may use the two-dimensional matrix barcode 28 to record the name of a favorite game in his/her account. Or the player may record the two-dimensional matrix barcode 28 to receive loyalty points, coupons for complimentary or discounted goods and services, or some other incentive that the gaming establishment offers to encourage players to visit the gaming machine 10 or a bank of gaming machines. In some cases, the player may be required to enroll in a program with the gaming establishment and login into his/her account to receive information and/or benefits relating to the two-dimensional matrix barcode 28. In addition to delivering information to the display 112, the software application on the visual aid 100 can update the player's account with the loyalty points or deliver electronic coupons or coupon codes to the player via the display 112.

If the visual aid 100 is the camera phone 150 as shown in FIG. 5, the software application may be a downloadable mobile application 158 on the camera phone 150. The mobile application 158 may optionally communicate with an external system 48 through the camera phone's wireless communications. For example, the mobile application 158 may communicate with an external system 48 that manages and stores data relating to the player's account with the gaming establishment. Alternatively, the external system 48 may be an information source that provides data relating to the two-dimensional matrix barcode 28.

TABLE 1 provides examples of input from the two-dimensional matrix barcode 28 (or other computer-readable symbol) and output from the software application installed on the visual aid 100.

TABLE 1

| | A | B | C | D | E |
|---|---|---|---|---|---|
| Input from symbol | Type of game/gaming machine | Type of game/gaming machine | Type of game/gaming machine | Specific identifier for gaming machine | Specific identifier for gaming machine |
| Output from software | Information on features of gaming machine and/or general rules/hints for corresponding games | Locations/ availability of same types of games/gaming machines and/or suggestions for other games/ gaming machines of interest | Information on special promotions/ events associated with the type of game/gaming machine | Alerts associated for specific gaming machine | Payout data for specific gaming machine |

In Example A, the player captures an image of the two-dimensional matrix barcode 28, and in response, the display 112 on the visual aid 100 provides information on features of the gaming machine 10. Alternatively or additionally, the display 112 provides general rules, or even hints, for the wagering game(s) on the gaming machine 10.

In Example B, the player captures an image of the two-dimensional matrix barcode 28, and in response, the display 112 on the visual aid 100 provides information on the location (s) and availability of the same type of games/gaming machine in the gaming establishment. Additionally, the display may provide information on the location(s) and availability of other similar games that may be of interest to the player. The output in Example B may be particularly advantageous when the particular gaming machine 10 is occupied by another player and the player wants to play the same or similar game. In some cases, the software application may allow the player to reserve a gaming machine to ensure that it will remain available until the player arrives at the gaming machine. In addition, the display 112 may provide a map or real-time directions to the location of an available gaming machine. Gaming establishments can achieve more efficient use of their gaming machine inventory by redirecting players to available gaming machines while providing players with a desired gaming experience.

In Example C, the player captures an image of the two-dimensional matrix barcode 28, and in response, the display 112 on the visual aid 100 provides information on special promotions/events associated with the type of game/gaming machine. For example, the gaming establishment may want to encourage players to play the particular gaming machine 10 or a bank of gaming machines by providing incentives, e.g., loyalty points, coupons, etc. Players can shop for games that provide such incentives by capturing the two-dimensional matrix barcodes 28 on gaming machines throughout the gaming establishment and receiving corresponding information on incentives. In another example, the gaming establishment may be conducting a tournament, scavenger hunt, or other group event in connection with the particular gaming machine 10, and the information from the visual aid 100 may provide information on the tournament, scavenger hunt, or group event.

In Example D, the player captures an image of the two-dimensional matrix barcode 28, and in response, the software application on the visual aid 100 provides alerts in connection with the particular gaming machine 10. For example, the software application may alert the player when his/her favorite gaming machine 10 becomes available for play. In some cases, the software application may allow the player to reserve the gaming machine 10 to ensure that it will remain available until the player arrives at the gaming machine 10.

In Example E, the player captures an image of the two-dimensional matrix barcode 28, and in response, the display 112 on the visual aid 100 provides information payout data for the particular gaming machine 10. For example, the player may receive information on recent, e.g., last ten, payouts by the gaming machine 10. Such information may include the time/date and amount of the most recent payouts and the number of wagers placed since the most recent payouts.

Although the examples above employ a two-dimensional barcode matrix 28 in combination with the software application on the visual aid 100, any information captured by the visual aid 100 may be used with software applications installed on the visual aid 100. The software applications may or may not be required to unlock the features or benefits provided by the information.

FIGS. 7A-B also show that invisible light can be employed to present information from other areas of the gaming environment 300, external to gaming machines. As FIG. 7A shows, a wall surface 350 and a floor surface 360 of the gaming environment 300 do not present information with visible light. The wall surface 350' and the floor surface 360' as seen by the visual aid 100, however, present information with invisible light. When viewed with the visual aid 100, the wall surface 350' and the floor surface 360' provide information on, and directions to, a VIP poker tournament. It is contemplated, however, that any number and variety of invisible light-emitting signs may be employed to provide information that may be of interest to people in the gaming environment 300. For example, a sign 370 shown with no information on FIG. 7A can be viewed with the visual aid 100 as a sign 370' with information in FIG. 7B. The sign 370' provides information relating to the wagering games. In particular, the sign 370' indicates that a "20% BONUS CASH" feature is currently available to players.

Of course, the invisible light-emitting signs may include other types of information. For example, the signs may provide advertising for products and services, directions to different areas of the gaming environment 200, information promoting play of particular games and/or gaming machines, etc. Advantageously, the use of invisible light signs can provide a large amount of easily accessible information without visually cluttering the gaming environment 200 with conventional signage that can be seen with visible light.

In addition to the embodiments described above, the displays 12, 14 on the gaming device 10 and other light-emitting areas throughout the gaming environment 300 may be employed to show advertising and other marketing/promotional information with invisible light. Thus, when patrons of a gaming establishment take pictures in the gaming environment 300, the pictures include the advertising and other marketing/promotional information, e.g., a hidden coupon image. In another example, the displays 12, 14 on the gaming device 10 and the light-emitting areas throughout the gaming environment 300 display the name of the gaming establishment, which can act as a type of watermark for pictures taken of the gaming environment 300. For example, the secondary display 14 in FIG. 4D provides the name of the gaming establishment.

In addition, the gaming device 10 may employ invisible light, e.g., from the secondary display 12, to alert employees of the gaming establishment that maintenance is required. Gaming machines needing attention can be easily identified by scanning the gaming environment with a visual aid. The alerts may include some specific information on the nature of the maintenance required. The maintenance alerts may be displayed using a specific wavelength that can only be detected by a specially configured visual aid available to employees, so that patrons cannot see the alerts even with their camera phones.

Although the embodiments described herein may show particular graphics and texts, it is understood that aspects of the present invention provide a general medium for detecting and displaying any graphic and/or any text. For example, in addition to the features described above, the displays 12 and 14 on the gaming machine may employ invisible light to indicate: the presence of "easter eggs," i.e., hidden messages, audiovisual features, etc., in the wagering game screens; the availability of additional games, e.g., bonus games, in the wagering game screens; hints and/or help for the wagering games of the gaming machine 10; and/or information relating to other games in the gaming establishment, e.g., hints, odds, scores, etc. for sportsbook players.

In general, to enhance a player's gaming experience, aspects of the present invention provide gaming-related displays that present text and graphics that are viewable with a special visual aid, such as a camera phone. The visual aid provides another interface that allows the player to interact with, and be engaged by, the gaming machine and the gaming environment. In addition, the text and graphics shown on the visual aid may provide information adds to player's experience. The use of invisible light offers a novelty that departs from the conventional gaming experience and attracts players.

Although the embodiments described herein may include displays that emit IR light, it is understood that other embodiments may communicate information by emitting light with other wavelengths outside the visible spectrum and may employ devices that detect these other wavelengths. Indeed, it is contemplated more generally that embodiments may communicate information by emitting light with one or more predetermined subsets of one or more wavelengths, regardless of whether they are inside or outside the visible spectrum, and such embodiments may employ devices that configured or programmed to detect the one or more predetermined subsets of one or more wavelengths. The use of IR wavelengths described above is an example of a predetermined subset of wavelengths. Even if a predetermined subset of wavelengths falls within the visible spectrum, the typical human eye may not necessarily be able to detect distinct patterns formed by these predetermined wavelengths, particularly when also subjected to the noise of other visible wavelengths. As such, special visual aids can be employed to detect these patterns and the corresponding information in a manner similar to the example embodiments described above.

Each of these embodiments and obvious variations thereof is contemplated as falling within the spirit and scope of the claimed invention, which is set forth in the following claims.

What is claimed is:

1. A gaming system primarily dedicated to playing at least one casino wagering game, the gaming system comprising:

at least one gaming cabinet housing an electronic display device emitting visible light in patterns associated with the at least one casino wagering game, the electronic display device including an invisible-light-emitting component that emits a predetermined pattern of invisible light having wavelengths outside of the visible electromagnetic spectrum through a screen of the electronic display device;

wherein the predetermined pattern of invisible light, when detected by a visual aid, converted into a corresponding pattern of visible light by the visual aid, and displayed concurrently with the emitted visible light on a display screen of the visual aid, provides additional information associated with the casino wagering game being played on the gaming system.

2. The gaming system of claim 1, wherein the emitted visible light includes images of game symbols from the at least one casino wagering game and the pattern of invisible light provides additional information about at least one of the game symbols when converted and displayed on the display screen of the visual aid.

3. The gaming system of claim 1, wherein the invisible light has wavelengths in the infrared spectrum.

4. The gaming system of claim 1, wherein the visual aid is a camera phone.

5. The gaming system of claim 1, wherein the pattern of invisible light modifies images that are included in the emitted visible light when converted and displayed on the display screen of the visual aid.

6. The gaming system of claim 1, wherein the pattern of invisible light enhances game images that are included in the emitted visible light when converted and displayed on the display screen of the visual aid.

7. A gaming machine primarily dedicated to playing at least one casino wagering game, the gaming machine comprising:

a gaming cabinet for housing components associated with the at least one casino wagering game;

an electronic display device coupled to the gaming cabinet, the electronic display device including an invisible-light-emitting component configured to emit a predetermined pattern of invisible light through a screen of the electronic display device;

one or more controllers disposed within the gaming cabinet and configured to:

direct the electronic display device to emit visible light in patterns associated with the at least one casino wagering game;

direct the invisible-light-emitting component to emit the predetermined pattern of invisible light, wherein the predetermined pattern of invisible light, when detected by a visual aid, converted into a corresponding pattern of visible light by the visual aid, and displayed concurrently with the emitted visible light on a display screen of the visual aid, provides additional information associated with the casino wagering game being played on the gaming machine.

8. The gaming machine of claim 7, further comprising a touch screen input device providing player input options, and wherein the pattern of invisible light reveals additional player input options when converted and displayed on the display screen of the visual aid.

9. The gaming machine of claim 7, wherein the casino wagering game includes a bonus picking game and wherein the pattern of invisible light provides hints that aid a player during the bonus picking game when converted and displayed on the display screen of the visual aid.

10. The gaming machine of claim 9, wherein the bonus picking game includes a plurality of selectable objects displayed on the electronic display device, and wherein the pattern of invisible light highlights one of the plurality of selectable objects when converted and displayed on the display screen of the visual aid.

11. The gaming machine of claim 9, wherein the pattern of invisible light reveals awards associated with unpicked objects when converted and displayed on the display screen of the visual aid.

12. The gaming machine of claim 9, wherein the pattern of invisible light reveals additional paylines in a reel-spinning game when converted and displayed through the display screen of the visual aid.

13. A method of operating a gaming system primarily dedicated to playing at least one casino game, the gaming system including a gaming cabinet, an electronic display device coupled to the gaming cabinet, the electronic display device including an invisible-light-emitting component, and one or more controllers, the method comprising:

directing, by at least one of the one or more controllers, the electronic display device to emit visible light in patterns associated with the at least one casino wagering game;

directing, by at least one of the one or more controllers, the invisible-light-emitting component to emit a predetermined pattern of invisible light through a screen of the electronic display device, wherein the predetermined pattern of invisible light, when detected by a visual aid, converted into a corresponding pattern of visible light by the visual aid, and displayed concurrently with the emitted visible light on a display screen of the visual aid, provides additional information associated with the casino wagering game being played on the gaming machine.

14. The method of claim 13, wherein the emitted visible light includes game images of the casino wagering game and wherein the pattern of invisible light enhances the game images when converted and displayed on the display screen of the visual aid.

15. The method of claim 13, wherein the pattern of invisible light displays a dynamic video when converted and displayed on the display screen of the visual aid.

16. The method of claim 13, wherein the casino wagering game includes a bonus picking game including a plurality of selectable objects displayed on the electronic display device, and wherein the pattern of invisible light provides hints that aid a player during the bonus picking game when converted and displayed on the display screen of the visual aid.

17. The method of claim 13, wherein the pattern of invisible light reveals additional paylines in a reel-spinning game when viewed through the display screen of the visual aid.

* * * * *